US009455128B2

(12) United States Patent
Remes et al.

(10) Patent No.: US 9,455,128 B2
(45) Date of Patent: Sep. 27, 2016

(54) METHODS OF OPERATING A FOURIER TRANSFORM MASS ANALYZER

(71) Applicant: Thermo Finnigan LLC, San Jose, CA (US)

(72) Inventors: Philip M. Remes, San Jose, CA (US); Michael W. Senko, Sunnyvale, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/741,360

(22) Filed: Jun. 16, 2015

(65) Prior Publication Data

US 2015/0364303 A1 Dec. 17, 2015

Related U.S. Application Data

(60) Provisional application No. 62/012,860, filed on Jun. 16, 2014.

(51) Int. Cl.
*H01J 49/42* (2006.01)
*H01J 49/00* (2006.01)

(52) U.S. Cl.
CPC ..... *H01J 49/0031* (2013.01); *H01J 49/4245* (2013.01)

(58) Field of Classification Search
CPC ..... H01J 49/0027–49/0036; H01J 49/4245; H01J 49/425
See application file for complete search history.

(56) References Cited

U.S. PATENT DOCUMENTS 8,399,827 B1 * 3/2013 Grothe ..... H01J 49/0036 250/282
2004/0217272 A1 * 11/2004 Horning ..... H01J 49/4265 250/282

OTHER PUBLICATIONS

Anderson, et al., "Experimental methods to alleviate ion coupling effects in matrix-assisted laser desorption ionization Fourier transform ion cyclotron resonance mass spectrometry," International Journal of Mass Spectrometry and Ion Processes (1996), 157/158, 163-174.

Gorshkov et al., "Calibration Function for the Orbitrap FTMS Accounting for the Space Charge Effect," J Am Soc Mass Spectrom 2010, 21, 1846-1851.

(Continued)

*Primary Examiner* — Wyatt Stoffa
*Assistant Examiner* — Eliza Osenbaugh-Stewar
(74) *Attorney, Agent, or Firm* — Charles B. Katz

(57) ABSTRACT

A method is disclosed for operating a mass spectrometer having a Fourier Transform (FT) analyzer, such as an orbital electrostatic trap mass analyzer, to avoid peak coalescence and/or other phenomena arising from frequency-shifting caused by ion-ion interactions. Ions of a first group are mass analyzed, for example in a quadrupole ion trap analyzer, to generate a mass spectrum. The estimated frequency shift of the characteristic periodic motion in the FT analyzer is calculated for one or more ion species of interest based on the intensities of adjacent (closely m/z-spaced) ion species. If the estimated frequency shift(s) for the one or more ion species exceeds a threshold, then a target ion population for an FT analyzer scan is adjusted downwardly to a value that produces a shift of acceptable value. An analytical scan of a second ion group is performed at the adjusted target ion population.

13 Claims, 3 Drawing Sheets

(56) References Cited

OTHER PUBLICATIONS

John T. Stults, "Minimizing Peak Coalescence: High-Resolution Separation of Isotope Peaks in Partially Deamidated Peptides by Matrix-Assisted Laser Desorption/Ionization Fourier Transform Ion Cyclotron Resonance Mass Spectrometry," Analytical Chemistry (1997), 69(10), 1815-1819.

Mo, et al., "Investigation of the mass shifts caused by the coupling of ion motions in the ion trap mass spectrometer," Rapid Communications in Mass Spectrometry (1996), 10(4), 424-428.

Nagao, et al., "Power of isotopic fine structure for unambiguous determination of metabolite elemental compositions: in silico evaluation and metabolomic application," Analytica Chimica Acta (2014), 813, 70-76.

Perry, Richard H., "Ion dynamics in the orbitrap mass analyzer and investigations into the chiral amplification of serine upon sublimation," Dissertation, UMI 3403284, 2009, Chpt. 4, pp. 147-165.

* cited by examiner

METHODS OF OPERATING A FOURIER TRANSFORM MASS ANALYZER

CROSS-REFERENCE TO RELATED APPLICATION

This application claims the priority benefit of U.S. Provisional Patent Application No. 62/012,860 by Philip M. Remes, et al. entitled "Adjustment of Target Ion Population in a Fourier Transform Mass Analyzer", the disclosure of which is incorporated herein in its entirety.

FIELD OF THE INVENTION

The present invention relates generally to methods for operating a mass spectrometer, and more particularly to a method for adjusting target ion populations in an orbital electrostatic trap mass analyzer.

BACKGROUND OF THE INVENTION

Fourier Transform (FT) mass analyzers are widely used in the mass spectrometry field for acquisition of high-resolution, accurate mass (HRAM) data. Examples of commercially-available FT mass analyzers include the orbital electrostatic trap mass analyzer (a version of which is sold as the Orbitrap mass analyzer by Thermo Fisher Scientific) and the ion cyclotron resonance (ICR) mass analyzer. Generally described, FT mass analyzers utilize electric or electromagnetic fields to confine ions to a trapping region, where the ions undergo periodic motion having frequencies characteristic of their mass-to-charge ratios (m/z's). A detector is utilized to measure a time-varying signal, referred to as a transient, generated by the motion of the trapped ions, and the transient is subsequently processed by performing a Fourier transform to convert it to the frequency space and thereby identify the characteristic frequencies representative of the ions' m/z's.

It is known that the performance of FT mass analyzers may be adversely affected by the interaction of ions with similar characteristic frequencies (see, e.g., Grinfield et al., "Crowd Control of Ions in Orbitrap Mass Spectrometry", 60$^{th}$ Amer. Soc. Mass Spectr. Conference Proceedings, 2012). Under certain operating conditions, the interaction of two adjacent ions (ions of closely spaced mass-to-charge ratios (m/z's)) results in a shift of both of their frequencies towards the other. This phenomenon may result in the coalescence (i.e., merging) of two closely spaced peaks in the mass spectrum into a single unresolved peak. Such a result is particularly problematic when it is desirable to separately identify or quantify closely spaced ions, for example ions of isotopologue species having identical molecular compositions but with different isotopic substitutions.

SUMMARY

Generally described, embodiments of the present invention incorporate a target ion population adjustment technique to avoid peak coalescence and other detrimental effects that may arise from space charge-related frequency shift in a Fourier Transform (FT) mass analyzer. In accordance with an illustrative method, a first group of ions is accumulated and subjected to mass analysis to generate a mass spectrum. For each one of a set of ion species of interest (which may include one or a plurality of ion species), an estimated frequency shift is calculated based on the intensity(ies) of one or more adjacent ion species in the mass spectrum. The term "adjacent ion species" refers to ion species having mass-to-charge ratios (m/z's) within a narrow specified m/z window relative to the corresponding ion species of interest. If it is determined that the estimated frequency shift for one or more of the ion species of interest exceeds a threshold value, then an adjusted (reduced) target ion population is calculated. The adjusted target population represents the maximum target population that maintains the frequency shift at or below the threshold value. Following calculation of the adjusted ion population, a second group of ions is accumulated for a period calculated from the adjusted target ion population, and the second group of ions is mass analyzed in the FT mass analyzer. In specific implementations, the mass analysis of the first ion group may be conducted in a quadrupole ion trap mass analyzer, and the FT mass analyzer may be an orbital electrostatic trap mass analyzer. In other specific implementations, the estimated frequency shift may be calculated for an analyte species of interest in accordance with the relation:

$$\Delta\hat{f} = \sum_i S(\delta f_i)A_i$$

where $\Delta\hat{f}$: frequency shift estimate $S(\delta f_i)$: frequency shift slope function determinable from $\delta f_1$ $\delta f_i$: frequency spacing for analyte and adjacent ion i $A_i$: abundance of adjacent ion i The adjusted target ion population may be calculated in accordance with the relation:

$$T_{New} = T_0 \frac{\text{thresh}}{|\Delta\hat{f}|}$$

where $T_{New}$: new target $T_0$: nominal target thresh: threshold

Embodiments of the invention also include a mass spectrometer having an ion source, an ion store positioned to receive ions from the ion source, and a FT mass analyzer. The mass spectrometer is provided with an instrument controller programmed with instructions for performing the method steps described above, namely accumulating and mass analyzing a first ion group to generate a mass spectrum, calculating frequency shifts for one or more ion species of interest based on the intensities of adjacent ion species, determining an adjusted targeted population if the calculated frequency shift(s) exceed a threshold, accumulating a second group of ions for a accumulation period determined from the adjusted target ion population, and mass analyzing the second group of ions in the FT mass analyzer.

DESCRIPTION OF ILLUSTRATIVE EMBODIMENTS

Figure 1:
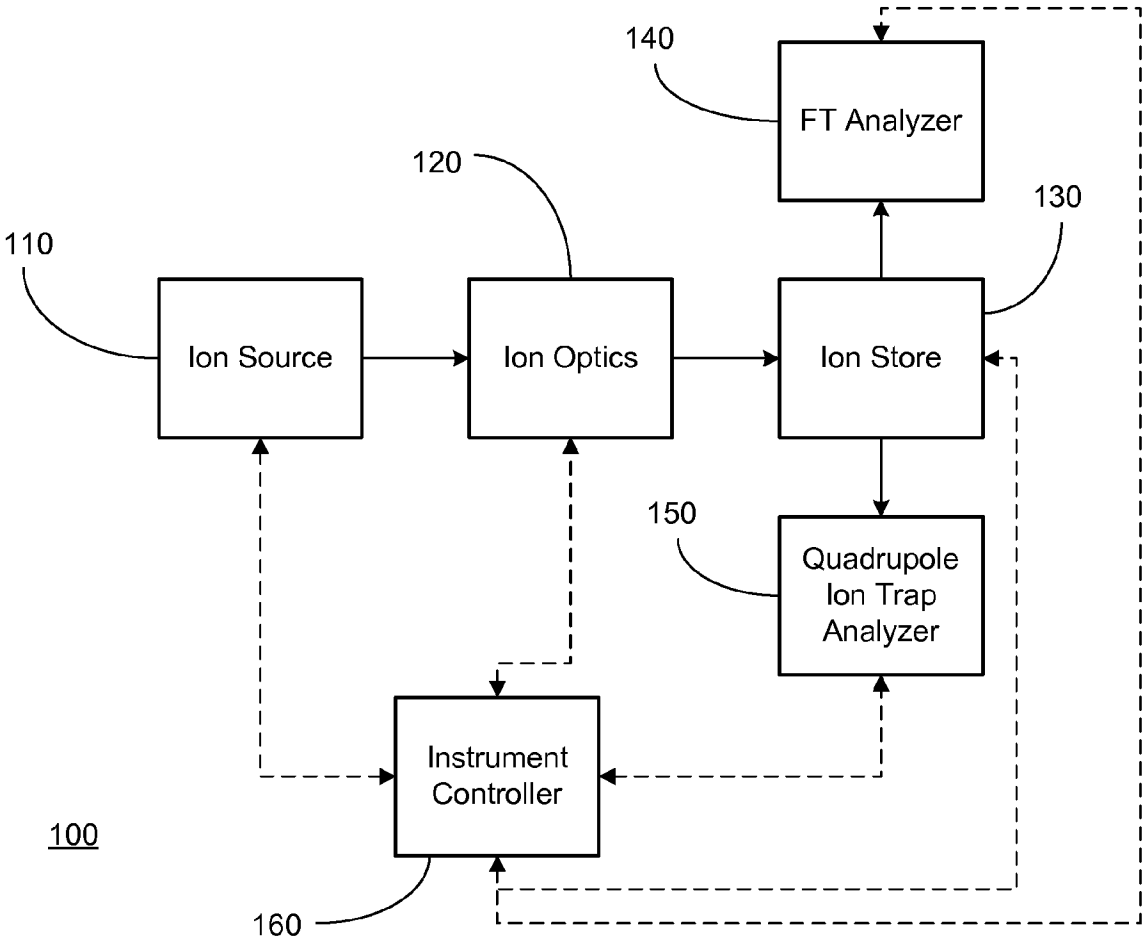
FIG. 1 symbolically depicts an example of a mass spectrometer in which embodiments of the present invention may be implemented.

FIG. 1 symbolically depicts components of a mass spectrometer 100 that may be utilized to practice embodiments of the present invention. Ions are generated by ion source 110 and delivered by ion optics 120 to an ion store 130. Ion source 110 may take the form of any suitable source known in the art for ionizing a sample material (e.g., the eluate from a liquid chromatography column), such as an electrospray ionization (ESI) or atmospheric-pressure chemical ionization (APCI) source. Ion optics 120 may include a combination of devices commonly utilized for transporting ions along a prescribed path, such as ion transfer tubes, radio-frequency (RF) multipoles, ion funnels, and RF or electrostatic lenses, and may also include devices utilized for mass selection (e.g., a quadrupole mass filter) or for ion dissociation (e.g., a collision cell). Ion store 130 may be an axially elongated multipole structure having a plurality of electrodes to which RF and DC voltages are applied to establish an electric field that confines ions to a trapping region. Ion optics 120 and/or ion store 130 may be equipped with an ion gating structure that selectively allows or impedes the delivery of ions from ion source 110 to ion store 130, such that ions may be directed to and accumulated in ion store 130 for an accumulation period of controllable duration, and blocked or diverted from entry into ion store 130 when the accumulation period has terminated.

Ions accumulated in ion store 130 may be selectably directed to either FT analyzer 140 or quadrupole ion trap analyzer 150 for mass analysis. As is known in the art and discussed above, an FT analyzer is one in which ions undergo periodic motion having frequencies that are a function of their m/z's. Acquisition of a mass spectrum representative of the m/z's and abundances of ion species in the analyzer is effected by processing a time varying signal, referred to as a transient, produced by the periodic motion of the ions (e.g, by generation of an image current on a detection electrode). The transient is subjected to a Fourier transform to convert it from the time to the frequency space. The Fourier transformed signal exhibits peaks, representative of particular ion species present in the analyzer, which may be mapped to m/z's via a calibrated relationship. In a particular implementation, and without limiting the scope of the invention, FT analyzer 140 takes the form of an orbital electrostatic trap mass analyzer in which a hyperlogarithmic trapping field is established, such that ions undergo harmonic oscillatory motion along the longitudinal axis of the analyzer, the frequencies of which are proportional to the square root of the m/z's. This type of analyzer is commercially available as the Orbitrap analyzer in mass spectrometers sold by Thermo Fisher Scientific. Other types of FT analyzers include ion cyclotron resonance (ICR) mass analyzers, which utilize a combination of electrical and magnetic fields to create m/z-dependent periodic motion of confined ions.

Quadrupole ion trap mass analyzer 150 may be a radial ejection two-dimensional quadrupole ion trap mass analyzer of the type available in instruments from Thermo Fisher Scientific. In such mass analyzers, acquisition of a mass spectrum is achieved by mass-sequential resonant ejection to a detector via application of a dipole excitation voltage and scanning of the trapping voltage, as is well known in the art.

Components of mass spectrometer 100 communicate with and are controlled by instrument controller 160, which will typically include a combination of general and special-purpose processors, application-specific circuitry, memory, storage and input/output devices. Instrument controller 160 is configured to execute program instructions, usually encoded as software, to effect desired instrument operations and to process data. The methods described below may be implemented as software code executed by processors of instrument controller 160.

It should be understood that while the mass spectrometer operation methods presented below are described in terms of their implementation on the mass spectrometer architecture depicted in FIG. 1, the methods should not be construed as being limited thereto; the description is provided by way of a non-limiting example for ease of explication.

Generally described, embodiments of the present invention provide a method for adjusting target ion population (and consequently the ion injection time) in an FT analyzer (e.g., an Orbitrap mass analyzer) to maintain frequency shift between adjacent ions below a desired threshold and thereby avoid or minimize peak coalescence. The method utilizes stored calibration data representing the frequency shift slope as a function of the frequency spacing between adjacent ions. It is noted that frequency, as used herein, denotes a characteristic frequency of periodic motion within an FT analyzer; for example the harmonic oscillatory motion of ions in the longitudinal (axial) dimension of an Orbitrap mass analyzer. In accordance with this method, a first mass analysis scan (sometimes referred to as a "prescan") is performed to measure the intensities of a subset of ions present in the ion population (the analyte ion(s) and ions adjacent thereto), for example the N most intense precursors present in a previously acquired full mass analysis scan and the adjacent ion species. For each of the analyte ions, an estimated frequency shift is determined from the measured intensities in the prescan and the stored calibration data. If it is determined that the estimated frequency shift for the analyte ion(s) exceeds a specified threshold, then the target population is reduced to a number sufficient to lower the estimated frequency shift such that it satisfies the specified threshold condition and avoids the potential peak coalescence problem.

Figure 2:
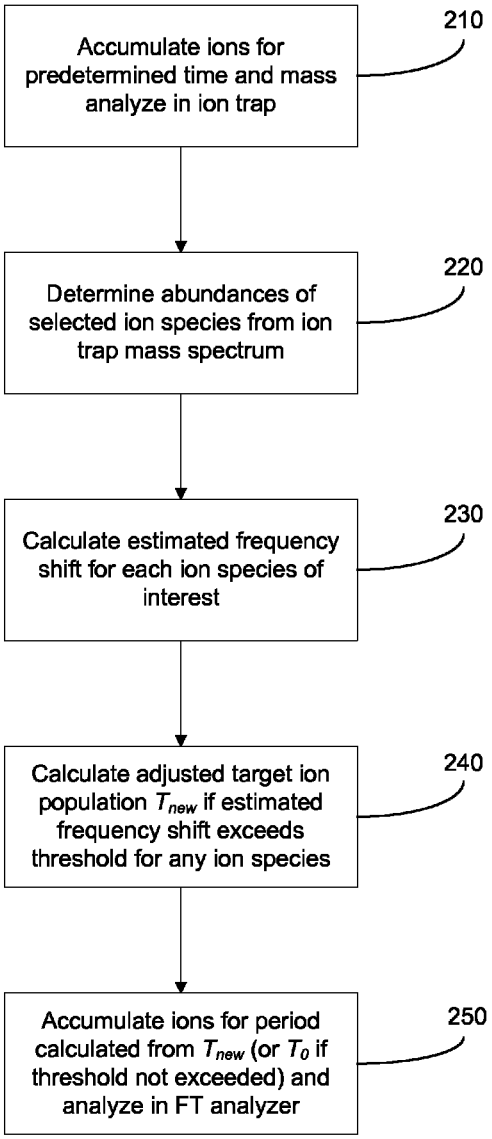
FIG. 2 is a flowchart depicting steps of a method for operating a mass spectrometer having an FT mass analyzer, in accordance with an illustrative embodiment.

An illustrative embodiment of the method of the invention is described below in reference to the FIG. 2 flowchart and the FIG. 1 mass spectrometer. In the initial step 210, a first group of ions generated by ion source 110 and delivered by ion optics 120 of mass spectrometer 100 is accumulated for a predetermined time and mass analyzed in quadrupole ion trap mass analyzer 150. Accumulation of the first group of ions may occur directly in ion trap mass analyzer 150, or in ion store 130 with subsequent transfer of ions to ion trap mass analyzer 150. The accumulation period will typically be calculated based on the target ion population for mass analysis in ion trap mass analyzer 150, and an ion flux (the number of ions delivered by ion optics 120 per unit time) determined from data contained in a previously acquired mass spectrum (i.e., a mass scan acquired shortly before the performance of step 210). The target ion population for the ion trap may be specified by the user or may be automatically set by instrument controller 160. As known in the art and discussed above, the mass analysis scan (prescan) may be performed in ion trap mass analyzer 150 by a resonant ion excitation method, which causes ions to be mass-sequentially ejected to a detector.

In the next step 220, the abundances are determined for a set of selected ion species (which may include a single ion species or multiple ion species) in the mass spectrum produced in step 210. As known in the art, the abundance for a particular ion species is determinable from the height or integrated area of its peak in the mass spectrum. Generally, the selected ion species will correspond to analyte species of interest and neighboring ion species. For example, the selected ion species may be the N most intense ion species measured in a prior mass analysis scan conducted in FT analyzer 140, together with ion species lying within a narrow m/z window (e.g., 1-4 Thomson) of each of the N most intense ion species (which will include different isotopic forms of the analyte species of interest). In alternative implementations, the selected ion species may comprise entries from a stored inclusion list and their neighboring ion species.

Figure 3:
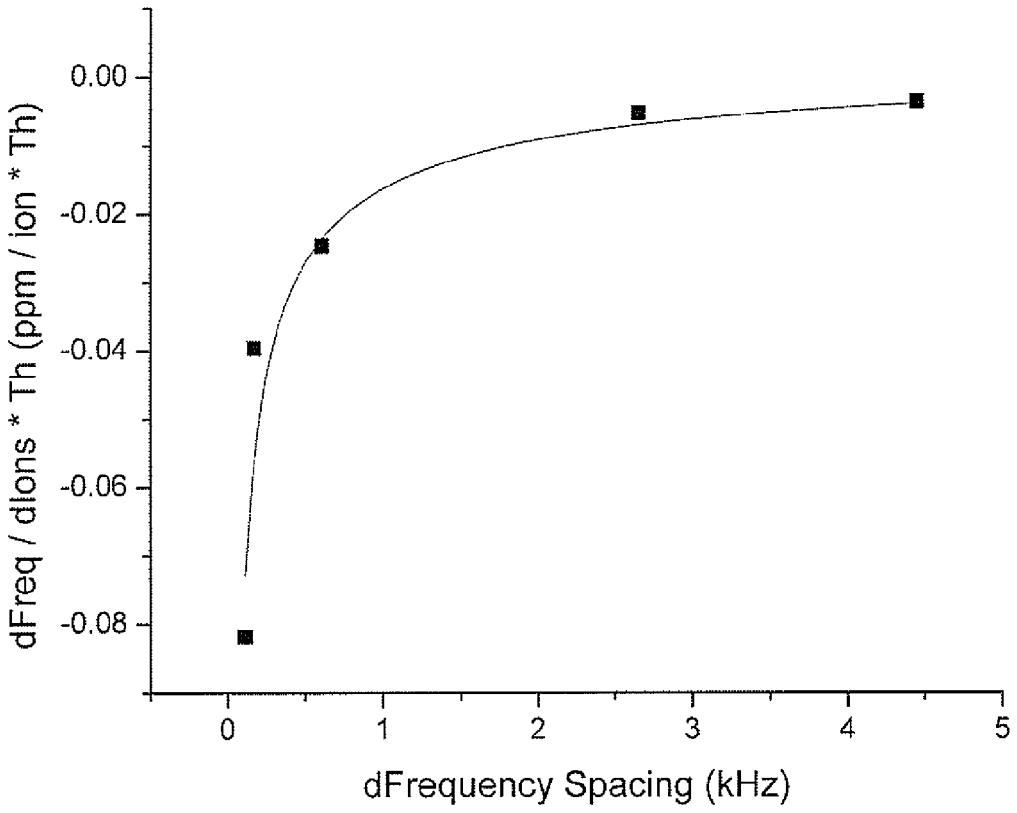
FIG. 3 is a graph having an example of a calibration curve used for determination of frequency shift.

In the next step 230, the estimated frequency shift for each ion species of interest is calculated from abundances derived from the mass spectrum acquired in step 220 and stored calibration data that represents the amount of frequency shift observed as a function of the frequency spacing and abundance of adjacent ions. In an exemplary implementation, the calibration data is empirically derived by measurements of frequency shift in FT mass analyzer 140 of pairs of adjacent ion species (which will typically be comprised of different isotopic variants of a compound) of known abundances and exact m/z values, which may be generated, for example, from a commercially available calibration mix. The calibration is performed by determining the frequency shift (the expected frequency, based on the m/z of an ion species minus the measured frequency, derived from the Fourier transformed transient signals produced, for example, by image current detection of the ion species in FT analyzer 140) for each of a plurality of pairs of adjacent ion species, the adjacent ion species pairs preferably spanning a substantial range of detectable m/z values. From the measured frequency shifts and the known values of the abundances and m/z's of the adjacent ion species pairs, a frequency shift slope (which may be in units of ppm/ion) may be calculated. The calculated frequency shift slope may then be plotted against the adjacent ion frequency spacing (which have an inverse proportionality to the square root of their m/z values), as depicted in FIG. 3 (which depicts the slope normalized for ion unit m/z). The variation of frequency shift slope with frequency spacing is dependent on the operating conditions of FT analyzer 140, such as the electrode voltages and the resolution setting, so it is desirable to acquire calibration data over a range of operating conditions such that the proper calibration curve may be selected for the calculation of estimated frequency shift, as described below. It has been found that the measured variation of m/z-normalized frequency shift slope with frequency spacing for a particular operating condition of an orbital electrostatic trap mass analyzer may be approximated with a curve of the appropriate mathematical form, as depicted in FIG. 3.

The estimated frequency shift may be calculated for an ion species of interest in accordance with the relation:

$$\Delta\hat{f} = \sum_i S(\delta f_i)A_i$$

where $\Delta\hat{f}$: frequency shift estimate $S(\delta f_i)$: frequency shift slope function determinable from $\delta f_i$ $\delta f_i$: frequency spacing for analyte and adjacent ion i $A_i$: abundance of adjacent ion i The abundances of the one or more adjacent ions (noting that the adjacent ions will include all ion species within a specified m/z window of the analyte ion species) are determined from the prescan spectra, as discussed above. In a typical implementation, the adjacent ions will include all ions within a window of 2 m/z of the analyte ion species. In certain implementations, the adjacent ions included in the estimated frequency shift will be limited to only ion species disposed in one direction of the mass spectrum relative to the analyte ion species, e.g., only those ion species having m/z's greater than the analyte ion species. If the peaks of the analyte and adjacent ions are not fully resolved in the prescan spectrum, then information from the prior FT analyzer scan (which will typically be performed at higher resolution relative to the linear ion trap scan) for the corresponding ion species may be used to estimate relative abundances of the non-resolved species. The frequency spacing for the analyte and adjacent ions is determined from their m/z values measured in the ion trap scan and/or the prior FT analyzer scan. As noted above, this frequency spacing is the expected difference in the characteristic frequencies of motion of the analyte and adjacent ions in FT analyzer 140, and may be calculated from an empirically derived or theoretical relationship between frequency and m/z. The frequency shift slope is determined from the frequency spacing using the empirically derived calibration curve, selecting the calibration curve (or extrapolating between two calibration curves) that matches or approximate the operating conditions of FT analyzer 140.

In the next step 240, it is determined, for each of the analyte species of interest, whether the absolute value of the estimated frequency shift exceeds a threshold value. The threshold value will be set with consideration to the particular experiment to be performed. For example, if the experiment involves independent quantitation of very closely spaced isotopologue species (i.e., ion species having a mass difference of considerably less than one Dalton), then the threshold may be set at a relatively low value to avoid peak coalescence; other experiments may be able to tolerate greater frequency shifts without compromising data quality. The threshold value may be specified by the user, may be calculated from user-supplied parameters (such as identification of analytes of interest and required resolution), or may be set automatically by instrument controller 160. If it is determined that the frequency shift exceeds the threshold, a new (reduced) target ion population is calculated according to the relation:

$$T_{New} = T_0 \frac{\text{thresh}}{|\Delta\hat{f}|}$$

$T_{New}$: new target $T_0$: nominal target thresh: threshold

The nominal ion population target $T_0$ is typically specified by the user, or set to a default value by the instrument. If it is determined in step 240 that two or more of the analyte species have frequency shift estimates that exceed the threshold (i.e., if multiple $T_{New}$ values are calculated), then the new ion population target used for the subsequent FT analyzer scan will be set to the smallest $T_{New}$ value calculated.

Next, in step 250 a second group of ions is accumulated to the target ion population value determined in step 240, and the accumulated second ion group is mass analyzed in FT analyzer 140. If in step 240, none of the analyte ion species are determined to have an estimated frequency shift exceeding the threshold, then the target ion population will be the nominal target $T_0$. Conversely, if one or more of the analyte ion species has or have frequency shift estimates exceeding the threshold, then the target ion population is set to the new, adjusted target population $T_{New}$. As is known in the art, the ions are accumulated to the desired target ion population by setting the accumulation period (alternatively referred to as the injection time (IT)) to a value equal to the target ion population divided by the ion flux, as determined, for example, from the prescan spectrum based on the measured abundances and accumulation time. For scans performed by FT analyzer 140, the ions may be accumulated in ion store 130, and then transferred to FT analyzer for subsequent mass analysis.

It should be noted that step 250, i.e., the accumulation of a second group of ions to an adjusted ion population and mass analysis of the second group of ions, need not be performed immediately after completion of the preceding steps and may involve intermediate, but should take place closely enough in time such that the values of ion flux and m/z distribution of ions produced by ion source 110 and delivered by ion optics 120 are similar to those values present during the preceding steps.

As described above, the adjustment of target ion population in accordance with the method of the invention avoids or reduces problems arising from excessive frequency shift of analyte ions, including the occurrence of peak coalescence. The results of the frequency shift calculation may also be utilized in other manners. In other implementations of the present invention, the empirically derived relationship between frequency shift slope and frequency spacing may be used, in conjunction with prescan data, to correct the measured m/z values in the subsequent FT analyzer scan. Other uses of this relationship may occur to those of ordinary skill in the art in view of the foregoing discussion.

It should be recognized that although the invention has been described in relation to a specific implementation, it should not be construed as being limited thereto. More specifically, the method of the invention may be employed for different types of mass analyzers and in different instrument configurations. Furthermore, although the steps of the method are depicted and discussed in reference to a particular sequence of steps, other implementations of the invention may perform two or more of the steps in parallel or in a different sequence.

What is claimed is:

1. A method for operating a mass spectrometer having a Fourier Transform (FT) mass analyzer, comprising:

(a) accumulating a first ion group over a first accumulation period;

(b) mass analyzing the first ion group to generate a mass spectrum;

(c) calculating an estimated frequency shift of at least one ion species of interest in the first ion group based on a mass-to-charge ratio and an intensity of one or more ion species adjacent to the at least one ion species of interest;

(d) determining an adjusted target ion population if the estimated frequency shift exceeds a threshold value;

(e) accumulating a second ion group over a second accumulation period calculated from the adjusted target ion population; and (f) mass analyzing the second ion group in the FT mass analyzer.

2. The method of claim 1, wherein the FT mass analyzer is an orbital electrostatic trapping mass analyzer.

3. The method of claim 1, wherein step (c) comprises calculating an estimated frequency shift for each of a plurality of ion species of interest, and step (d) comprises determining an adjusted target ion population if the estimated frequency shift for any one of the plurality of ion species of interest exceeds the threshold value.

4. The method of claim 1, wherein step (c) comprises calculating the estimated frequency shift for the at least one species of interest in accordance with the relation:

$$\Delta\hat{f} = \sum_i S(\delta f_i)A_i$$

where $\Delta\hat{f}$: frequency shift estimate $S(\delta f_i)$: frequency shift slope function determinable from $\delta f_i$ $\delta f_i$: frequency spacing for analyte and adjacent ion i $A_i$: abundance of adjacent ion i.

5. The method of claim 1, wherein step (b) is performed in an ion trap mass analyzer.

6. The method of claim 1, wherein the threshold value is operator-specified.

7. The method of claim 1, wherein the at least one ion species is identified from its intensity in a previously acquired mass spectrum.

8. The method of claim 1, wherein the adjusted target ion population is calculated in accordance with the relation:

$$T_{New} = T_0 \frac{\text{thresh}}{|\Delta\hat{f}|}$$

where $T_{new}$: adjusted target $T_0$: nominal target thresh: threshold.

9. A mass spectrometer comprising:

an ion source;

an ion store positioned to receive ions from the ion source;

a Fourier Transform (FT) mass analyzer; and an instrument controller programmed with instructions for causing the mass spectrometer to perform steps of:

(a) accumulating a first ion group in the ion store over a first accumulation period;

(b) mass analyzing the first ion group to generate a mass spectrum;

(c) calculating an estimated frequency shift of at least one ion species of interest in the first ion group based on a mass-to-charge ratio and an intensity of one or more ion species adjacent to the at least one ion species of interest;

(d) determining an adjusted target ion population if the estimated frequency shift exceeds a threshold value;

(e) accumulating a second ion group over a second accumulation period calculated from the adjusted target ion population; and (f) mass analyzing the second ion group in the FT mass analyzer.

10. The mass spectrometer of claim 9, wherein the FT mass analyzer is an electrostatic orbital trapping mass analyzer.

11. The mass spectrometer of claim 9, further comprising an ion trap mass analyzer, and wherein the instrument controller is programmed with instructions for performing step (b) in the ion trap mass analyzer.

12. The mass spectrometer of claim 9, wherein step (c) comprises calculating an estimated frequency shift for each of a plurality of ion species of interest, and step (d) comprises determining an adjusted target ion population if the estimated frequency shift for any one of the plurality of ion species of interest exceeds the threshold value.

13. The mass spectrometer of claim 9, wherein step (c) comprises calculating the estimated frequency shift for the at least one species of interest in accordance with the relation:

$$\Delta\hat{f} = \sum_i S(\delta f_i)A_i$$

where $\Delta\hat{f}$: frequency shift estimate $S(\delta f_i)$: frequency shift slope function determinable from $\delta f_i$ $\delta f_i$: frequency spacing for analyte and adjacent ion i $A_i$: abundance of adjacent ion i.

* * * * *